US007650890B2

(12) United States Patent
Goldberg

(10) Patent No.: US 7,650,890 B2
(45) Date of Patent: Jan. 26, 2010

(54) TRASH CONTAINER FOR DISPOSAL OF CIGARETTE WASTE

(75) Inventor: Mark Goldberg, Lido Beach, NY (US)

(73) Assignee: Global Equipment Company, Inc.

( * ) Notice: Subject to any disclaimer, the term of this patent is extended or adjusted under 35 U.S.C. 154(b) by 383 days.

(21) Appl. No.: 10/833,988

(22) Filed: Apr. 28, 2004

(65) Prior Publication Data

US 2005/0241655 A1 Nov. 3, 2005

(51) Int. Cl.
*A24F 13/16* (2006.01)
*A24F 19/00* (2006.01)
*A24D 1/12* (2006.01)

(52) U.S. Cl. ..... 131/231; 220/576

(58) Field of Classification Search ..... 131/231; 206/246, 514; 220/475, 576
See application file for complete search history.

(56) References Cited

U.S. PATENT DOCUMENTS 413,222 A * 10/1889 Brewington et al. ..... 414/441
2,437,226 A * 3/1948 Fischer ..... 220/576
4,739,892 A * 4/1988 Tudek ..... 215/232
6,186,355 B1 * 2/2001 Luedecke ..... 220/576

* cited by examiner

*Primary Examiner*—Philip C Tucker
*Assistant Examiner*—Phu H Nguyen
(74) *Attorney, Agent, or Firm*—Davidoff Malito & Hutcher LLP

(57) ABSTRACT

The container for disposal of cigarette waste includes a base, a hollow stem having an outer wall that contains an interior cavity of the hollow stem. The stem further includes a top and a bottom, where the stem is coupled to the base at the bottom. The container also includes a removable cap which is detachably coupled to the top of the stem. It further includes a disposal bucket attached to the cap. Once the cap is coupled to the top of the stem, the disposal bucket is suspended in the interior cavity of the stem. At least one hole is made through the outer wall of the stem near the top. Once the disposal bucket is placed in the interior cavity of the stem, the hole is located between disposal bucket and the cap.

17 Claims, 11 Drawing Sheets

FIG. 5a.
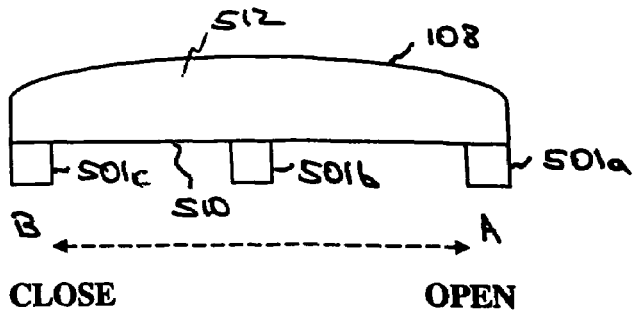
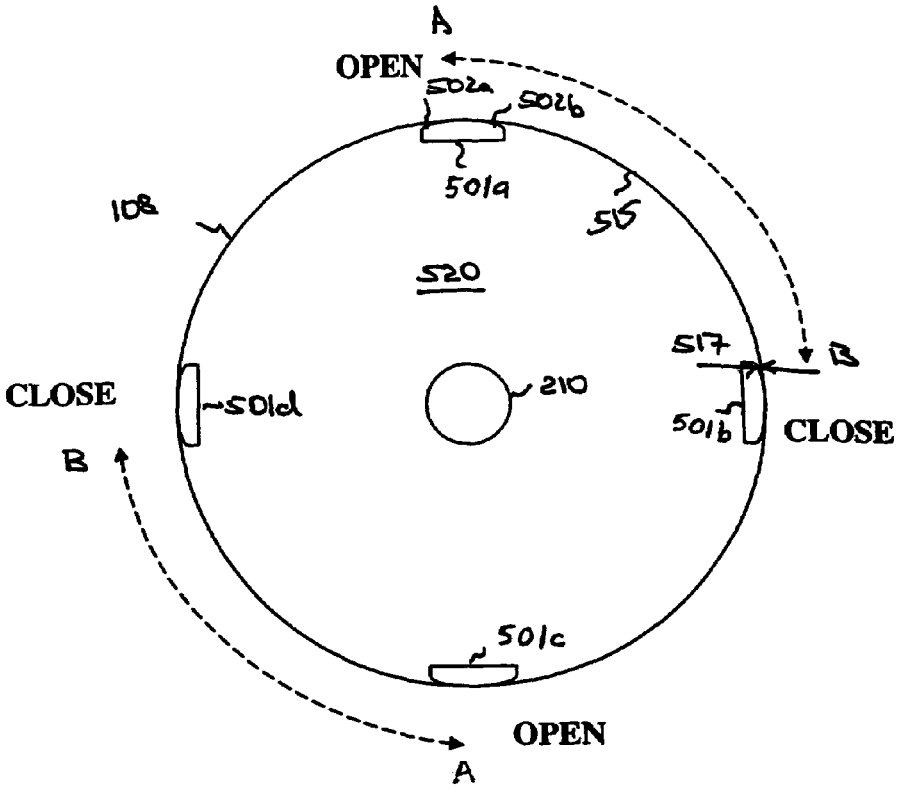
FIG. 5b.

BLOCK 550

TRASH CONTAINER FOR DISPOSAL OF CIGARETTE WASTE

BACKGROUND OF THE INVENTION

1. Field of the Invention

The present invention relates generally to systems and methods for disposal of cigarette waste; and, more specifically, to an indoor or an outdoor ashtray that allows easy clean-up of cigarette remnants and prevents unpleasant odors from escaping into a surrounding environment.

2. Background Art

Even with the ban on smoking in restaurants, bars, and other public places in some states, the number of smokers did not decline. In the states where the ban is in effect, smokers come out in front of the buildings to smoke. While smoking in front of a building, smokers' cigarettes produce a lot of ashes and burnt cigarette remnants. Typically, a smoker would tap on a cigarette to shake off the ashes. The ashes spread in the air and then fall on the ground. This causes pollution, dirt, and other unsightly conditions to spread around. Similarly, many smokers throw burnt cigarette remnants on the street as well. Some smokers even throw out their smoked cigarettes without extinguishing. This causes cigarettes to continue burning and spreading unpleasant smells and creating fire hazards.

In the states where smoking is allowed in restaurants, bars, and other public places, smokers typically shake off cigarette ashes and extinguish cigarettes in an ashtray. Besides being an unsightly view, burning or burnt cigarettes in an ashtray spread unpleasant smells to the surrounding environment if ashtrays are not immediately cleaned. Even if ashtrays are immediately cleaned, some of the cigarettes can still be burning and, thus, cause fires in trash compactors.

There have been many solutions to the above problems. Some solutions prevent littering of the environment from the ashes and burnt cigarette remnants but create unpleasant smells and do not allow easy clean up of the container collecting cigarette waste. Others may allow easy clean up but may cause devastating fires. Yet other solutions can only be used outdoors, while others only indoors. Therefore, there exists a need for a better cigarette disposal container capable of keeping the environment litter-free, eliminating unpleasant smells, preventing fires, allowing easy clean up and being able to be used indoors and outdoors. The present invention provides such a container.

SUMMARY OF THE INVENTION

The present invention relates to systems and methods for disposal of cigarette waste such as ashes and burnt cigarette remnants. More specifically, the present invention relates to a container for disposal of cigarette waste in a safe, easy, and environmentally sound way.

In an embodiment, the container for disposal of cigarette waste includes a base, a hollow stem having an outer wall that contains an interior cavity of the stem. The stem further includes a bottom and a top, where the stem is coupled to the base at the bottom. The stem is further sealed at the bottom by the base. The container also includes a removable cap having an interior surface and an exterior surface, where the cap is detachably coupled to the top of the stem. It further includes a disposal bucket attached to the removable cap's interior surface. Once the removable cap is attached to the top of the stem, the disposal bucket is located in the interior cavity of the stem. The container also includes at least one hole made through the outer wall of the stem near the top. Once the disposal bucket is placed in the interior cavity of the stem, the hole is located between disposal bucket and the removable cap. In an alternate embodiment, the hole can partially encompass the cap.

Further features and advantages of the present invention as well as the structure and operation of various embodiments of the present invention are described in detail below with reference to the accompanying drawings.

BRIEF DESCRIPTION OF THE FIGURES

The accompanying drawings, which are incorporated herein and form part of the specification, illustrate the present invention and, together with the description, further serve to explain the principles of the invention and to enable a person skilled in the relevant art(s) to make and use the invention.

FIG. 5*a* is a side view of the disposal container's cap, according to an embodiment of the present invention.

FIG. 5*b* is a bottom view of the disposal container's cap, according to an embodiment of the present invention.

The present invention is described with reference to the accompanying drawings. In the drawings, like reference numbers indicate identical or functionally similar elements. Additionally, the leftmost digit of a reference number identifies the drawing in which the reference number first appears.

DETAILED DESCRIPTION OF THE INVENTION

While the present invention is described herein with reference to illustrative embodiments for particular applications, it should be understood that the invention is not limited thereto. Those skilled in the art with access to the teachings provided herein will recognize additional modifications, applications, and embodiments within the scope thereof and additional fields in which the present invention would be of significant utility.

1. Overview

The present invention provides for a clean and safe disposal of ashes and smoked cigarettes, cigars, or other smoking objects (hereinafter "cigarettes"). The present invention substantially eliminates unpleasant smells by including an enclosed container, which prevents emanation of smells into the surrounding environment. Further, the present invention eliminates fires caused by a cigarette that was not properly extinguished. The present invention is designed to receive a burning cigarette into a metallic container and extinguish it by depriving it of oxygen. Finally, the present invention allows easy clean-up of the container. A bucket containing cigarette remnants is removed and its contents are emptied into a safe trash receptacle. The disposal bucket is returned to the interior portion of the container after cleaning, which allows continuous use of the container.

2. Trash Container for Disposal of Cigarette Waste

Figure 1:
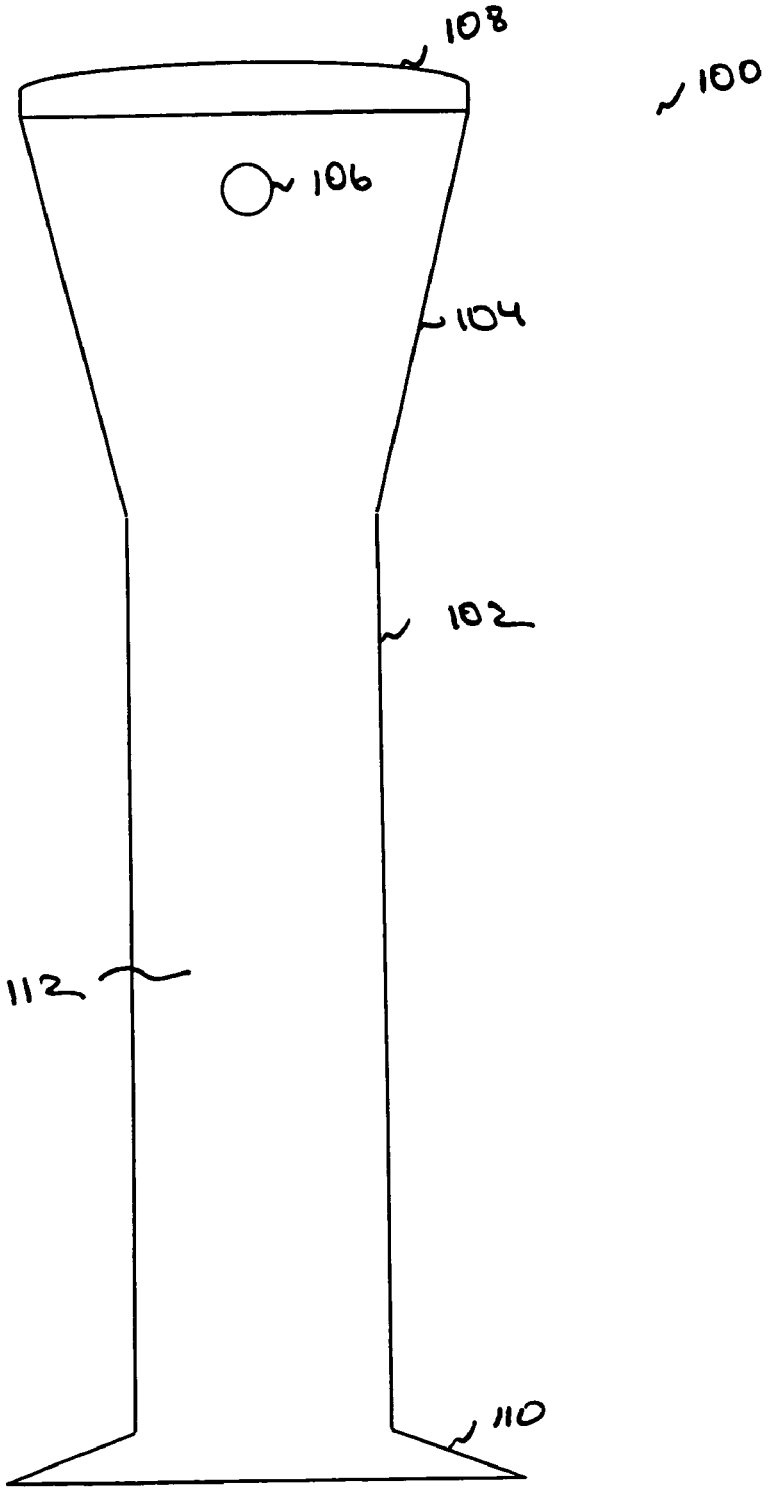
FIG. 1 illustrates a disposal container, according to an embodiment of the present invention.

The present invention is described in FIGS. 1-10. FIG. 1 illustrates a trash container 100 for disposal of cigarette waste. Trash container 100 includes a base 110, a stem 112 having an outwardly expanded portion 104, a cap 108 and at least one hole 106. Trash container 100 further includes an outer wall 112 that surrounds an interior cavity of container 100 (not shown in FIG. 1). The base 110 is attached at a bottom potion of the stem 102 and the cap 108 is detachably coupled to a top portion of the stem 102 and opposite the base 110. The hole 106 is made in the wall 112 in the outwardly expanded portion 104 of the stem 102. In this embodiment, the hole 106 is made in an upper part of the outwardly expanded portion 104 and in a near proximity to the cap 108. In other embodiments, the hole's location can vary depending on a height of the container 100. The outwardly expanded portion 104 assists the ashes and burnt cigarettes in falling through the interior cavity of the container 100 after being placed through the holes 106.

Figure 10:
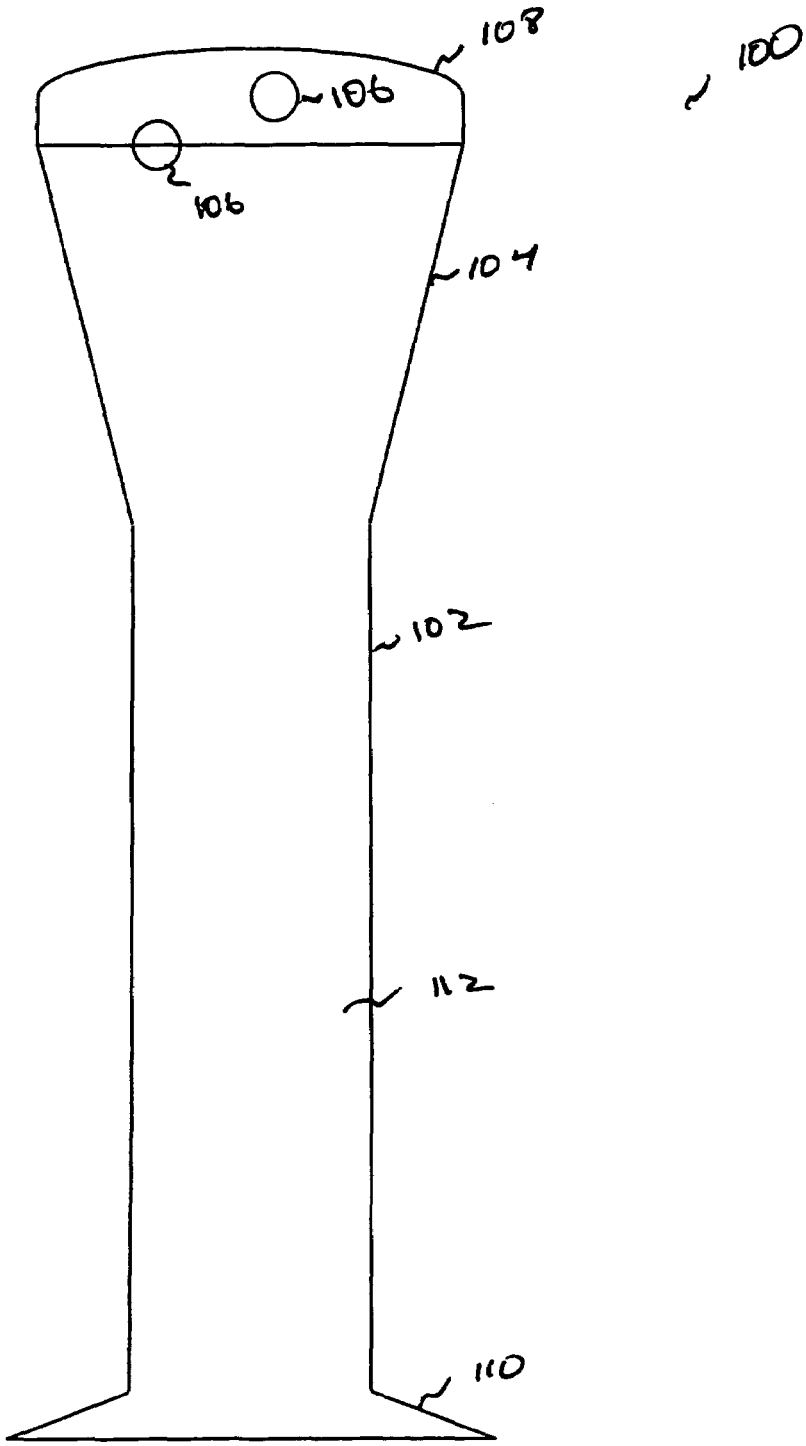
FIG. 10 is yet another embodiment of the disposal container.

Further, as can be understood by one having ordinary skill in the relevant art, the base 110 and the stem 102 can be considered a single element. This means that the base 110 can be a part of the stem 102 or vice versa and manufactured from a single shape molding. Also, it should be understood by one having ordinary skill in the relevant art, the location of the hole 106 is not limited to the one shown in FIG. 1. The hole 106 can be placed in the cap 108, or it can partially encompass the cap 108 and the stem 102, as shown in FIG. 10. This means that a part of the hole 106 is made in the stem 102 and the other part of the hole is made in the cap 108.

The container 100 can be manufactured from a fire resistant material, such as metal, sheet rock, or other materials having similar properties. Further, a coat of paint can be applied to the outer wall 112. The paint can be fire and/or heat resistant to further alleviate possibility of fire or overheating of the trash container 100.

Figure 2:
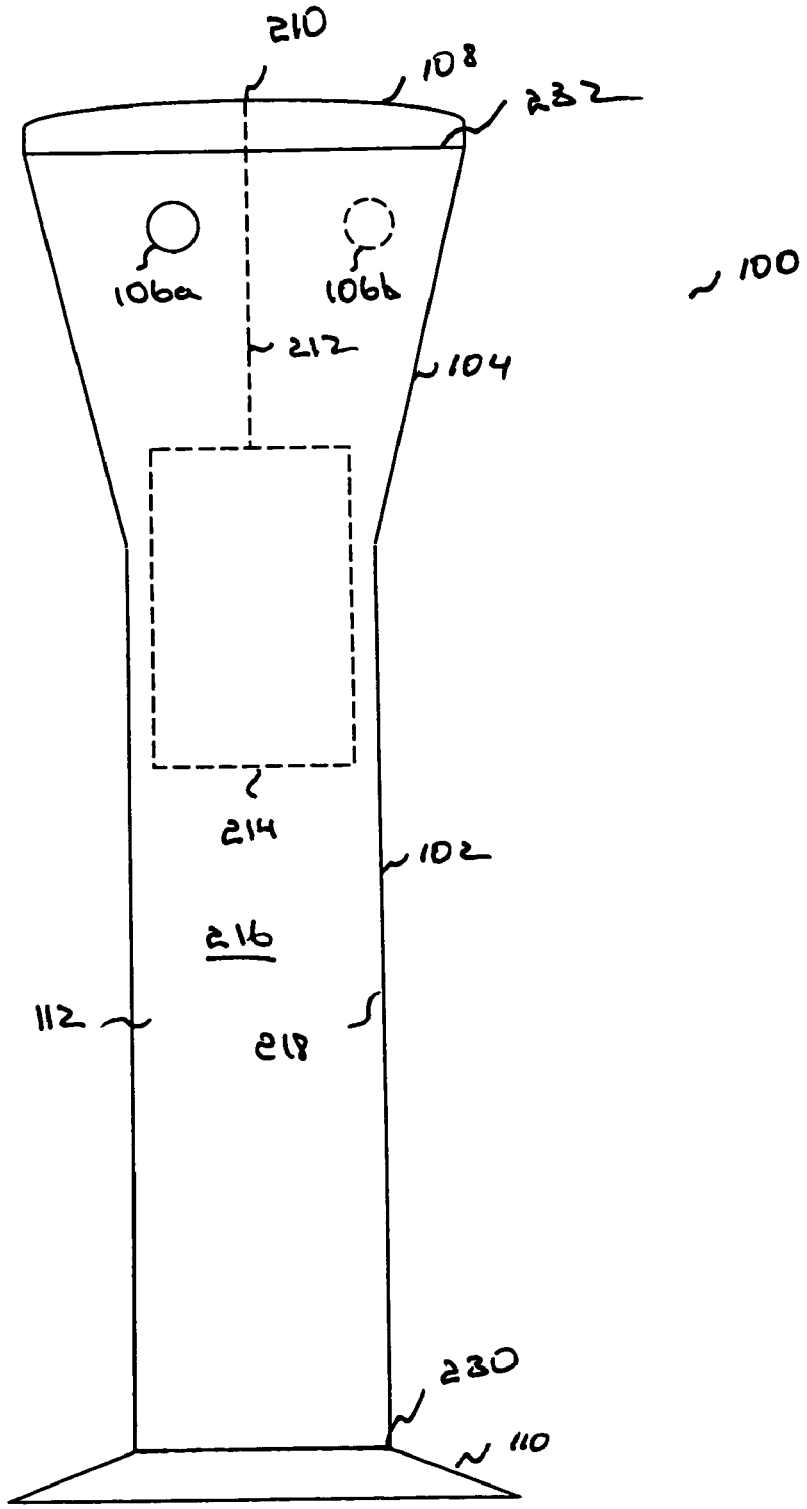
FIG. 2 illustrates the disposal container of FIG. 1 showing a disposal bucket attached to a cap of the container, according to an embodiment of the present invention.

FIG. 2 illustrates further details of the trash container 100. The stem 102 includes an interior cavity 216. The interior cavity 216 is confined between the outer wall 112 and top 232 and a bottom 230 of the stem 102. The top 232 receives the cap 108. The bottom 230 is a border where the stem 102 is coupled to the base 110. The interior portion 216 of the stem 102 is sealed off by the bottom 230. The bottom 230 further serves as port of the base 110.

The interior cavity 216 further includes a disposal bucket 214 having an attachment string 212. The bucket 214 and attachment string 212 are shown by dashed lines. The bucket 214 has an open end, a bottom and a sidewall. The bucket's 214 sidewall runs in a near proximity of and along the interior wall 218 of the stem 102. Because the bucket's wall is in a near proximity of the interior wall 218, gaps are substantially eliminated when the bucket 214 is placed in the interior cavity 216. One end of the attachment string 212 is coupled to the bucket 214 at bucket's open end. The other end of the attachment string 212 is coupled at a point 210 on the cap 108, as shown in FIG. 2.

In an alternate embodiment, the bucket 214 is not attached to the cap 108, but can be suspended from the cap 108 at point 210. In yet alternate embodiment, a hole is made through the cap 108, through which the attachment string 212 is passed and secured by a rod not coupled to the cap 108 in any way. The attachment string 212 holding the bucket 214 can slide in and out through the hold in the cap 108.

Figure 3:
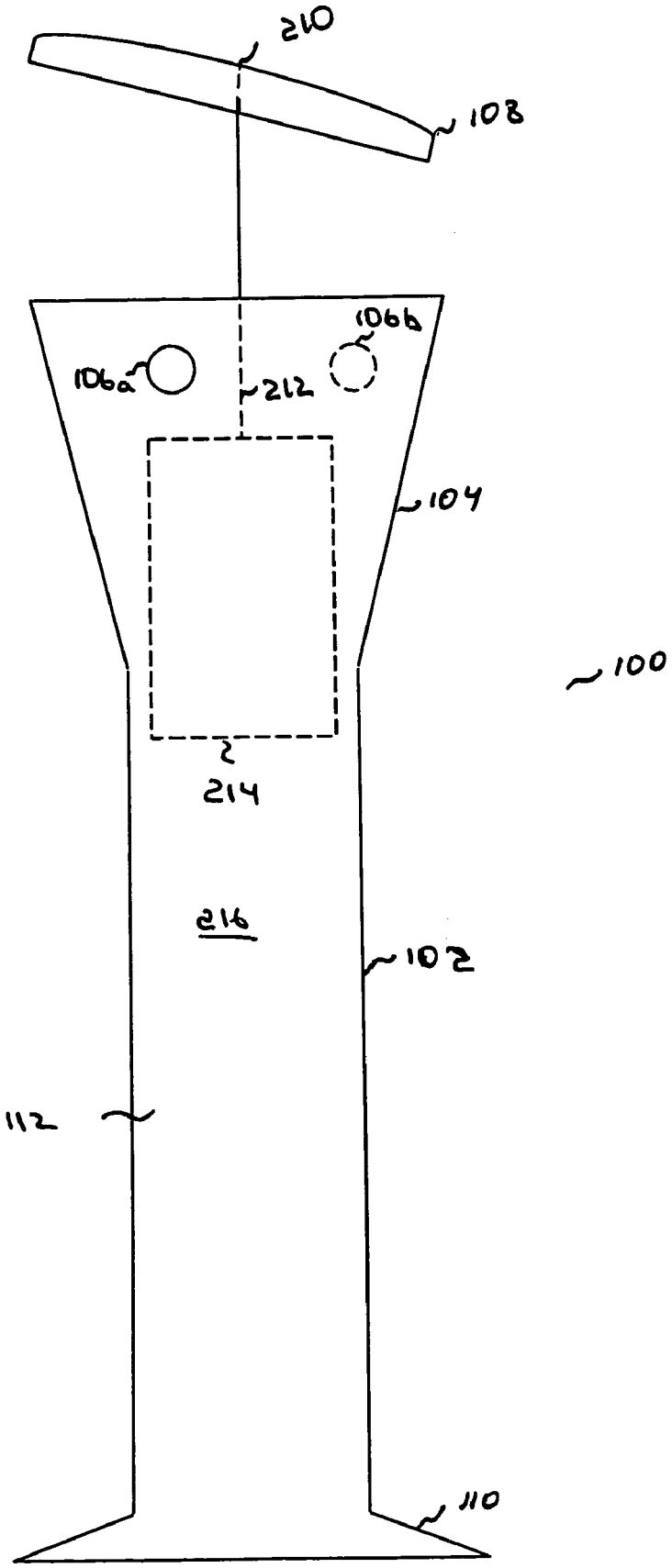
FIG. 3 illustrates the disposal container of FIG. 1 showing the cap removed from the container partially exposing a chain holding the disposal bucket, according to an embodiment of the present invention.
Figure 4:
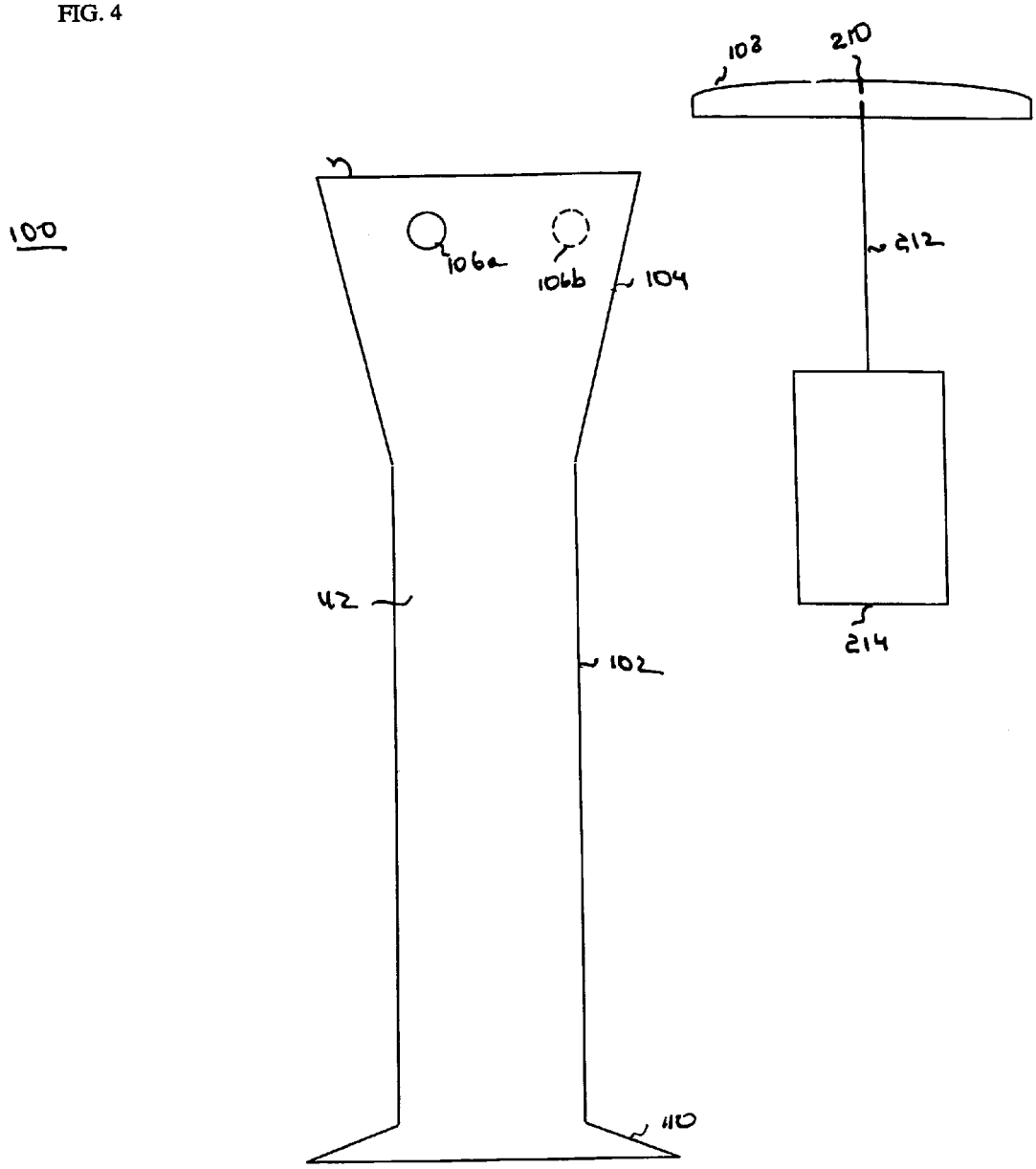
FIG. 4 illustrates the disposal container of FIG. 1 showing the cap and the disposal bucket completely removed from the container, according to an embodiment of the present invention.

FIG. 3 illustrates cap 108 removed from the top 232 of the stem 102 partially exposing the chain 212 that holds the bucket 214. In an embodiment, the cap 108 is removed by pulling it away from the top 232. Because bucket 214 is attached to the cap 108, pulling allows removal of the entire bucket 214 from the interior cavity 216 of the stem 102. FIG. 4 illustrates bucket 214 attached to the cap 108 completely taken out from the interior cavity 216 of the stem 102. The bucket 214 is hanging on the chain 212. In an alternate embodiment, the bucket 214 can be attached to the cap 108 using a rigid, elastic, or semi-elastic rod. To avoid breaking or burning the rod as a result of a contact with hot cigarette ashes, the rod can be manufactured from a fire and/or heat resistant material. Likewise, the chain 212 can be manufactured from a fire resistant material to avoid breaking or burning it. As can be understood by one having ordinary skill in the relevant art, the ways of attaching the bucket 214 to the cap 108 are not limited to a chain or a rod. Strings, springs, or any other methods can be used. These methods can provide that upon re-placement of the cap 108 on the top of the stem 102, the disposal bucket 214 is located in the interior cavity 216.

Figure 5D:
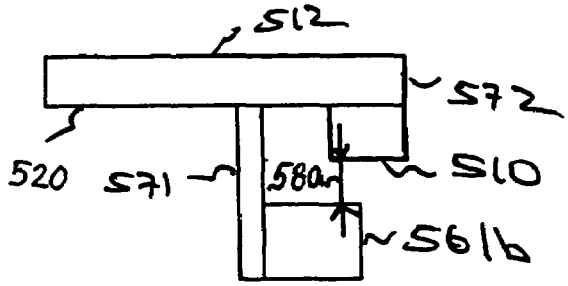
FIG. 5*d* is an enlarged portion of FIG. 5*c*.
Figure 6:
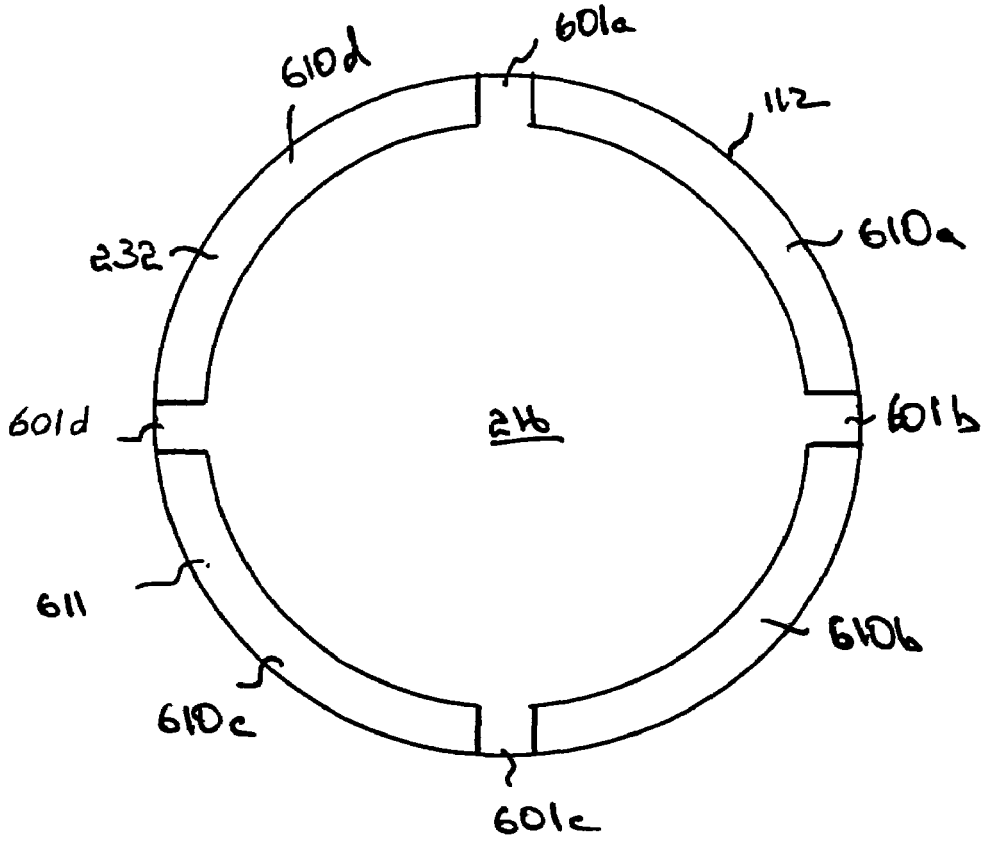
FIG. 6 is a top view of a rim of the disposal container's stem, according to an embodiment of the present invention.

FIGS. 5*a* and 5*b* are side and bottom views of the cap 108, respectively. Referring to FIG. 5*a*, cap 108 includes a top portion 512 having a bottom edge 510 and pins 501*a*, 501*b*, 501*c*, and 501*d* (pin 501*d* is not shown). Pins 501 are secured to the bottom edge 510 of the cap 108. Pins 501 can be manufactured out of metal, plastic or any other suitable material. The pins serve to firmly secure the cap 108 to the top portion 232 of the stem 102 (not shown in FIG. 5*a*). This is illustrated by the description of FIG. 6 below. As can be understood by one having ordinary skill in the relevant art, one pin is enough to couple the cap 108 to the top 232 of the stem 102. As shown in FIG. 5*a*, the cap 108 has a round dome shape. It is also understood by one having ordinary skill in the relevant art that other shapes of the cap 108 are possible.

Referring to FIG. 5*b*, the pins 501 include a slanted sidewalls 502*a* and 502*b*. The slanted sidewalls 502 form gaps 517 between an interior surface 515 of the cap 108 and surfaces of the pins 501. The slanted sidewalls 502 and gaps 517 allow the pins 501 to firmly attach the cap 108 to the stem 102. The cap 108 can be attached to the stem 102 by performing a twisting motion indicated by directional arrows A and B, as shown in FIGS. 5*a* and 5*b*. For example, to disengage the cap 108 from the stem 102, it is twisted in the A direction. To securely attach the cap 108 to the stem 102, the cap is twisted in the B direction. The opening and closing of the cap will be further described with respect to FIG. 6 below. FIG. 5*b* further shows chain 212 attachment point 210. The attachment point 210 is secured to an interior portion 520 of the cap 108. At least one pin 501 can be used to secure the cap 108 to the top 232 of the stem 102.

Figure 5C:
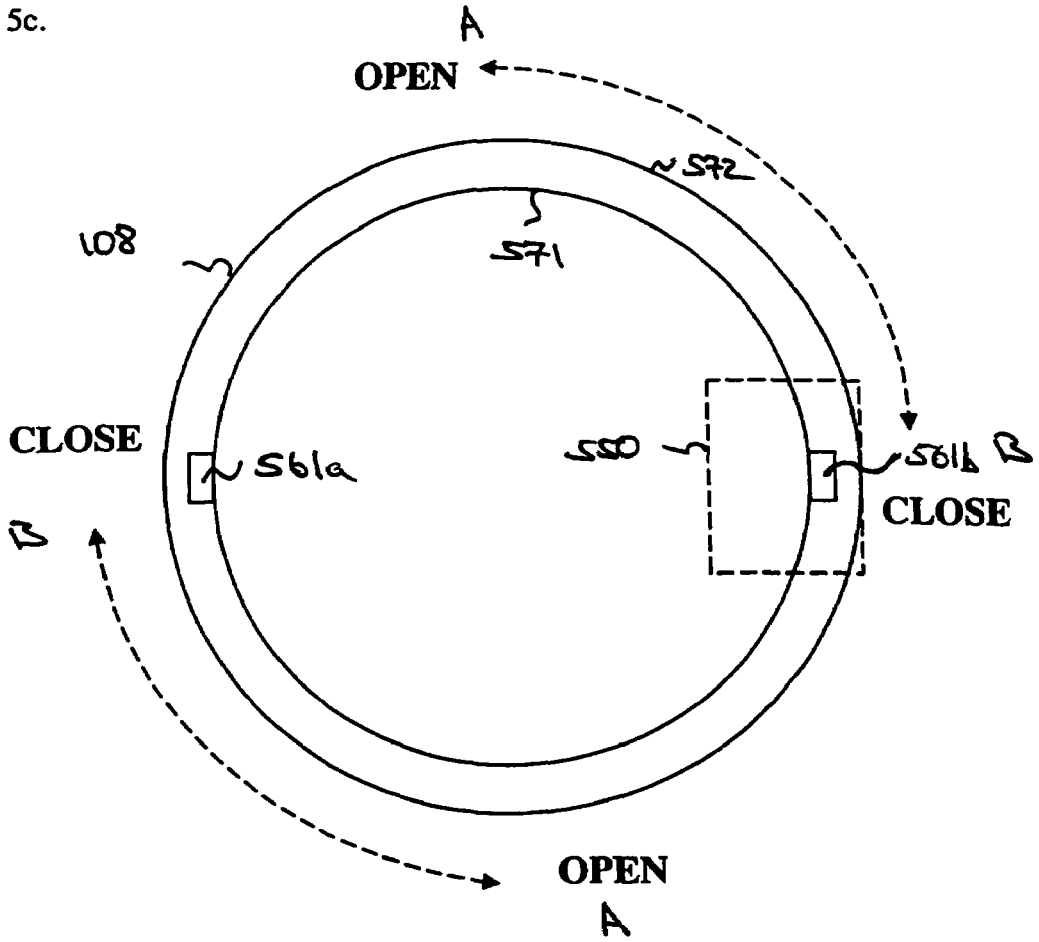
FIG. 5*c* is a side view of the disposal container's cap, according to another embodiment of the present invention.

FIG. 5*c* illustrates an alternative embodiment of the cap 108. FIG. 5*d* illustrates a portion of FIG. 5*c* in more detail. In this embodiment, cap 108 includes pins 561 (*a, b*) attached to an interior rim 571 of the cap 108. Rim 571 extends from the interior portion 520 of the cap 108. It further extends beyond the bottom edge 510 of the cap 108, as shown in FIG. 5*d*. The pin 561*b* is attached to rim 571 so that a gap 580 is formed between the bottom edge 510 and a top surface of the pin 561*b*. Similar situation exists for other pins 561. When cap 108 is placed on the top 232 of the stem 102, the pins 561 are accommodated so that upon twisting the cap into closed or open directions, the cap 108 is either securely coupled to the top 232 or disengaged from the cap 108, respectively. As can be understood by one having ordinary skill in the relevant art, one pin 561 can be used to perform all of the above functions.

FIG. 6 illustrates the top 232 of the stem 102. The top portion includes rim 611 having rim portions 610*a*, 610*b*, 610*c*, and 610*d*. The rim portions 610 have a thickness that is slightly less than the length of the gap 517 (for the embodiment shown in FIGS. 5*a* and 5*b*) or the gap 580 (for the embodiment shown in FIGS. 5*c* and 5*d*). The rim 611 further includes holes 601*a*, 601*b*, 601*c*, and 601*d*. The holes 601 are placed between the rim portions 610. The holes receive pins 501 (or pins 561) when the cap 108 is placed on the top 232.

Referring to FIGS. 5*a*, 5*b*, and 6, when cap 108 is placed on the top 232 and twisted in a "close" direction, rim portions 619 come in contact with pins 501. Specifically, gaps 517 receive rim portions 610. Further, the gaps 517 prevent the rim portions from being removed from the top 232 of the stem 102 by blocking the upward pulling motion of the cap 108 away from the stem 102. To unlock the cap 108, it is twisted in an "open" direction.

Referring to FIGS. 5*c*, 5*d*, and 6, when cap 108 is placed on the top 232 and twisted in a "close" direction, rim portions 610 come in contact with pins 561, interior rim 571, and bottom edge 510 of the cap 108. Specifically, the gap 580 receives the rim portions 610. The combination of the pins 561, interior rim 571, and bottom edge 510 of the cap 108 hold the rim portions 610 and prevent removal of the cap 108 from the top 232 of the stem 102.

As can be understood by one having ordinary skill in the relevant art, other methods for locking the cap 108 can be used.

Figure 7:
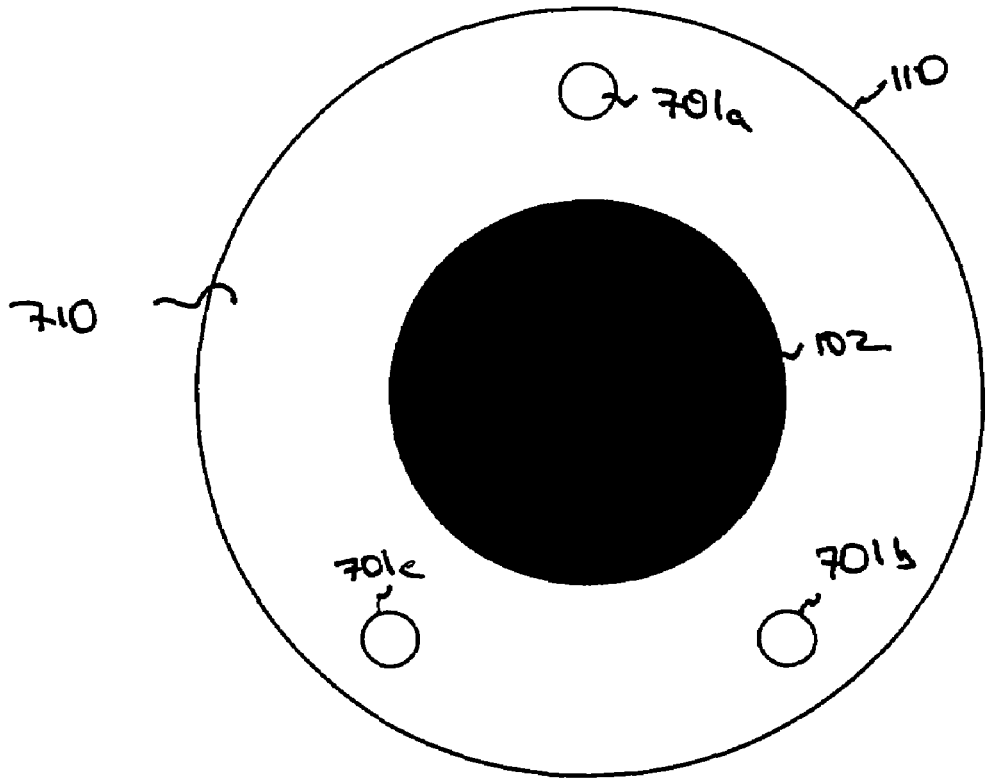
FIG. 7 is a top view of the disposal container's base, according to an embodiment of the present invention.

FIG. 7 is a top view of the base 110 of the trash container 100. The base 110 includes a top surface 710. Stem 102 is coupled to the top surface 710. The base further includes holes 701*a*, 701*b* and 701*c*. Using holes 701, the trash container 100 is secured to a surface using screws, bolts, or other means. This prevents tipping over of the container or theft and vandalism of the container. As can be understood by one having ordinary skill in the relevant art, one hole 701 is enough to secure the trash container to any surface. Also, glue, epoxy, welding, or other means of attachment to surfaces can be used. However, as would be apparent to one having ordinary skill in the relevant art, it is not necessary to attach the container to any surface at all. The trash container 100 can be a free standing container and can be moved around as desired.

Figure 8:
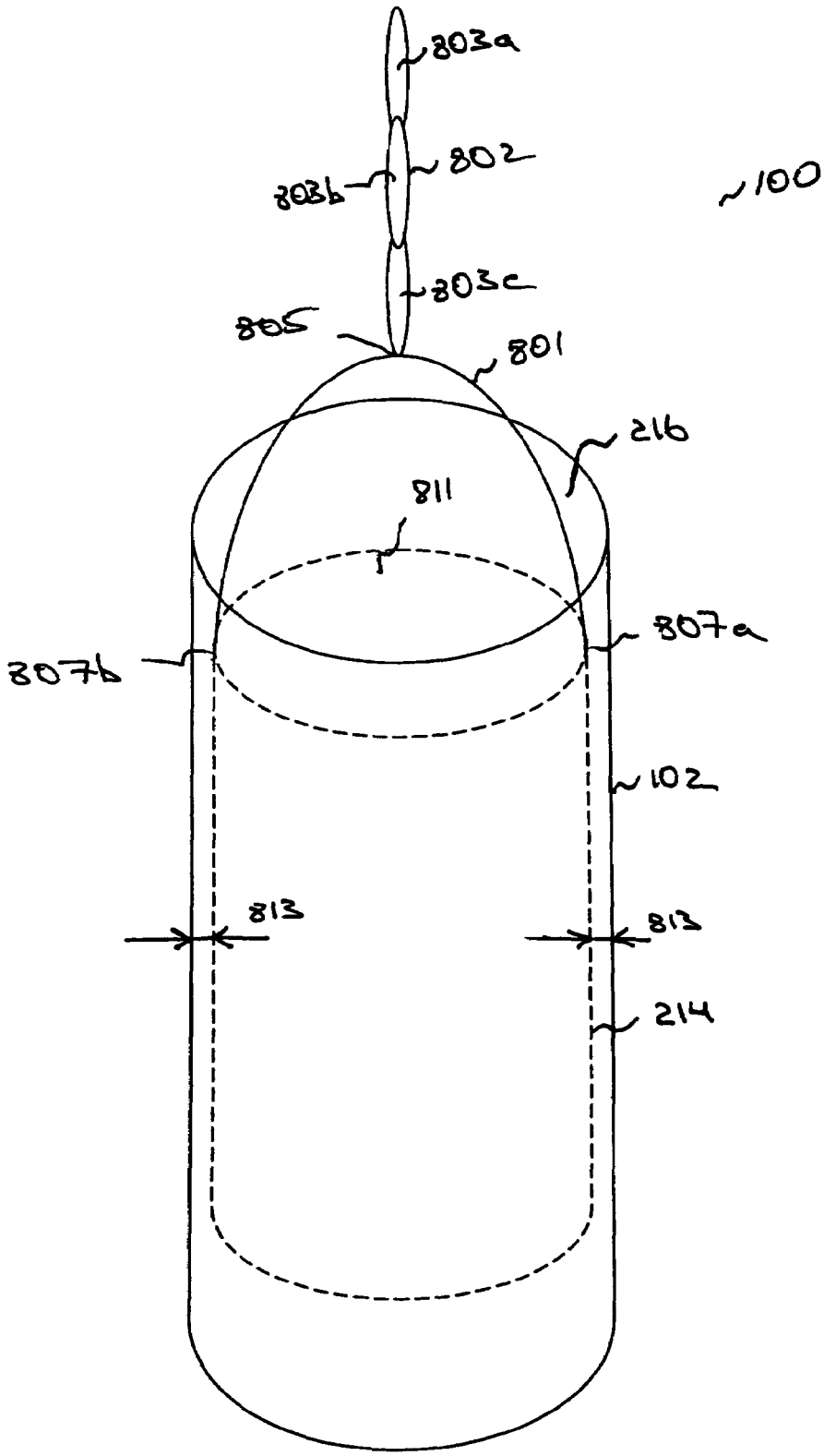
FIG. 8 is a three-dimensional view of a portion of the disposal container's stem with the disposal bucket placed in the stem's interior portion, according to an embodiment of the present invention.

FIG. 8 is a three-dimensional view of a portion of the stem 102 of the trash container 100. The portion of the stem 102 includes the disposal bucket 214 shown by the dashed lines. The disposal bucket 214 further includes a handle 801. The handle 801 is attached to the disposal bucket 214 using hooks or any other methods at attachment points 807*a* and 807*b*. At its top 805, the handle 801 is further attached to a chain 802. The chain 802 includes chain links 803 (*a, b, c*) and is coupled to the cap 108 (not shown in FIG. 8).

The disposal bucket 214 is placed in the interior cavity 216 of the stem 102. The disposal bucket's 214 dimensions are such that it fits inside the stem 102. For easy removal of the disposal bucket 214, space 813 is created between the exterior wall of the disposal bucket 214 and the interior wall of the stem 102. The space 813 is small enough to disallow any trash to fall through to the base of the stem 102 (not shown in FIG. 8). However, the space 813 is large enough to assist easy removal of the disposal bucket 214 during clean-up and maintenance of the interior 811 of the disposal bucket 214.

Figure 9:
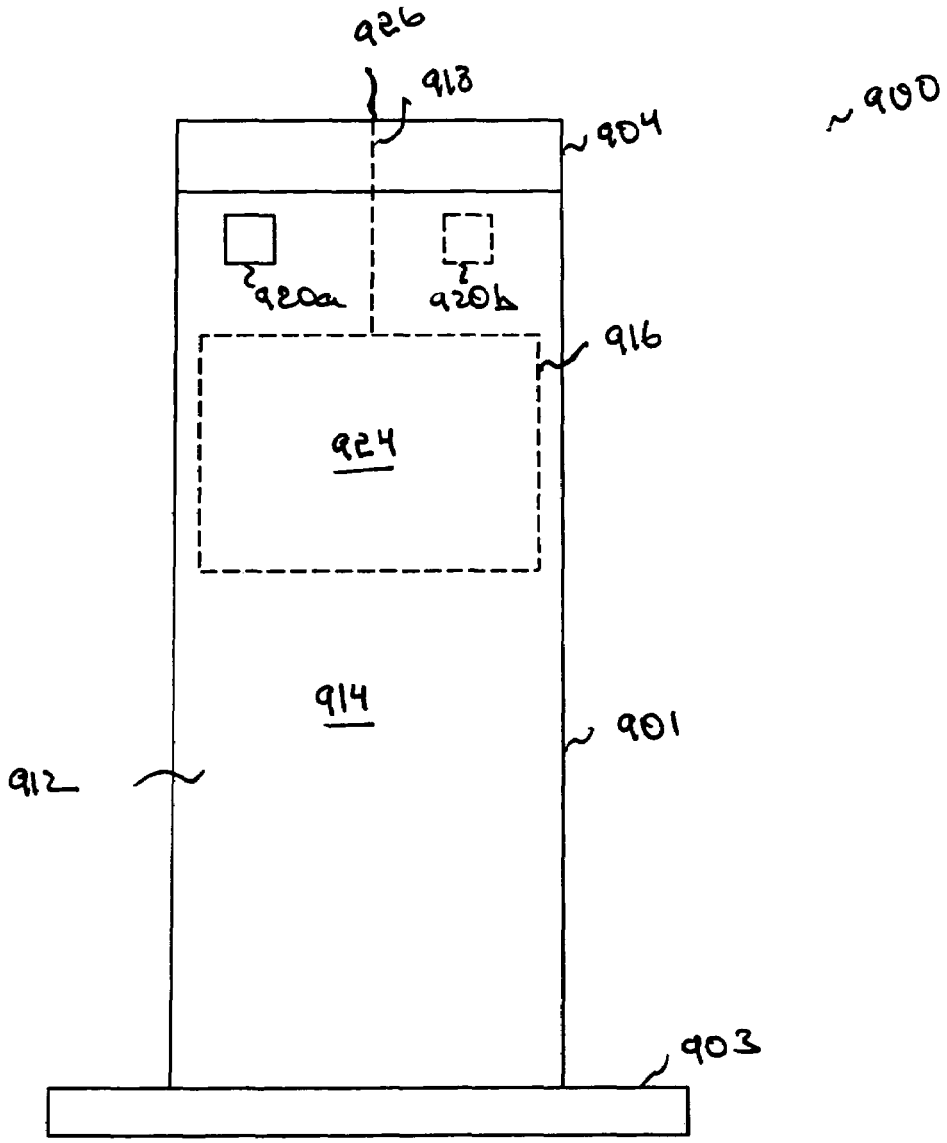
FIG. 9 is an alternate embodiment of the disposal container.

FIG. 9 illustrates a trash container 900, according to an alternate embodiment of the present invention. The trash container 900 includes a square-shaped stem 901, a base 903, a cap 904, cigarette holes 920(*a, b*), and a disposal bucket 916 with a chain 918. The base 903 is coupled to the stem 901 at a bottom end. The cap 904 is detachably coupled to a top end of the stem 901. The disposal bucket 916 is placed in the interior portion 914 of the stem 901. The bucket 916 is further attached to the cap 904 using a chain 918.

Similarly to FIGS. 1-8 embodiments, the disposal bucket 914 can be removed from the interior space 914 upon pulling the cap 904 away from the top end of stem 901. After removal of the disposal bucket 914 from the stem 901, an interior portion 924 of the disposal bucket 914 is cleaned. After cleaning out the disposal bucket 914, it is returned to the interior portion of the stem 901.

3. Method of Using and Cleaning the Trash Container

The following is a brief description of methods for using and cleaning the trash container shown in FIGS. 1-9. A cigarette (a cigar or any other smoking device) while being smoked accumulates ashes. While smoking, a smoker periodically places the burning cigarette partially through the hole 106 inside the stem 102 and taps on the cigarette to shake off excess of the accumulated ashes. The ashes fall inside the stem 102 into the disposal bucket 214. The ashes accumulate at the bottom of the disposal bucket 214. After finishing smoking the cigarette, the smoker simply places the entire burnt cigarette through the hole 106 inside stem 102 and releases it. The burnt cigarette falls inside the stem 102 into the disposal bucket 214. Once inside the disposal bucket 214, the cigarette continues to burn. Because of lack of oxygen inside the disposal bucket 214 necessary for the cigarette to continue to burn, the cigarette is quickly extinguished. Subsequent smokers can repeat the same procedure while smoking. Further, because the trash container 100 can include more than hole 106, several smokers are able to use the trash container simultaneously.

The trash container 100 is also designed for easy clean up. To prevent overfilling of the disposal bucket, the trash container 100 can be periodically cleaned. To clean the trash container 100, the cap 108 is twisted off and pulled away from the top of the stem 102 of the trash container 100. By pulling the cap 108, the disposal bucket 214 is removed from the interior portion 216 of the stem 102. Upon removal of the bucket, the contents of the bucket are safely disposed off. Safe disposal of the bucket's contents can be performed because the cigarettes have been already extinguished.

Therefore, the trash container 100 substantially eliminates accumulation of unsightly trash (ashes and smoked cigarettes) in front of buildings, the streets, and other public places. It also prevents possibilities of fires and smoke dispersion into the atmosphere.

4. Conclusion

Example embodiments of the methods, and components of the present invention have been described herein. As noted elsewhere, these example embodiments have been described for illustrative purposes only, and are not limiting. Other embodiments are possible and are covered by the invention. Such embodiments will be apparent to persons skilled in the relevant art(s) based on the teachings contained herein. Thus, the breadth and scope of the present invention should not be limited by any of the above-described exemplary embodiments, but should be defined only in accordance with the following claims and their equivalents.

What is claimed is:

1. A container for disposal of cigarette waste, comprising: a stem having opposite ends between which extends an elongated outer wall that bounds an interior cavity of said stem, one of said opposite ends being open; a removable cap closing said one of said opposite ends of said stem thereby providing said container with a side and a top, said top extending in a direction transverse to that of said side; and a disposal bucket dangling from said cap into said interior cavity of said stem in a manner that spaces away said disposal bucket from said cap as said cap closes said one of said opposite ends, said side defining an entry location that enables access to said interior cavity of said stem from outside, said entry location being spaced away from said top.

2. The container of claim 1, further comprising a base coupled to a further opposite end of said stem.

3. The container of claim 1, wherein said cap further comprises a locking mechanism configured to couple said cap to said stem.

4. The container of claim 3, where said locking mechanism further comprises two engaging configurations that engage each other to securely lock said cap to said stem, one of said engaging configurations being part of said cap and other of said engaging configurations being part of said stem.

5. The container of claim 1, wherein said disposal bucket is configured to slide along an interior of said outer wall of said stem.

6. The container of claim 1, wherein said disposal bucket is dangling from said cap with a chain.

7. The container of claim 1, wherein said disposal bucket is dangling from said cap with a rod.

8. The container of claim 1, wherein said disposal bucket is dangling from said cap with a rope.

9. The container of claim 1, wherein said disposal bucket is configured and arranged to be removable from said interior portion of said hollow stem by pulling on said removable cap away from said hollow stem, whereby cigarette waste can be emptied from said disposable bucket.

10. A method for emptying contents, the method comprising the steps of: opening an end of a stem closed by a cap that has a disposal bucket dangling from said cap in a manner that spaces away said disposal bucket from said cap by removing an entirety of said cap from a stem of a cigarette disposal unit before any part of said disposal bucket emerges from said stem; removing said disposal bucket from an interior cavity of said stem subsequent to complete removal of said cap from said stem, emptying contents of said disposal bucket; returning said emptied disposal bucket in said interior cavity of said stem; and returning said cap on said stem.

11. A cigarette disposal unit, comprising: a container and a base, said container being elongated and having an open end; a cap detachably coupled to said container to close said open end thereby providing said disposal unit with a side and a top, said top extending in a direction transverse to that of said side; and a disposal bucket dangling in an interior portion of said container in a manner that spaces away said disposal bucket from said cap as said cap closes said open end, said side defining an entry location that enables access to said interior portion of said stem from outside, said entry location being spaced away from said top.

12. The cigarette disposal unit of claim 11, further comprising a locking mechanism that couples said cap to said container.

13. The cigarette disposal unit of claim 11, wherein said disposal bucket is dangling from said cap with a chain.

14. The cigarette disposal unit of claim 11, wherein said disposal bucket is dangling from said cap with a rod.

15. The cigarette disposal unit of claim 11, wherein said disposal bucket is dangling from said cap with a rope.

16. A cigarette disposal unit, comprising: components that include a stem, a cap, and a disposal bucket dangling from said cap in a manner that spaces away said disposal bucket from said cap as said cap closes an open end of said stem, said disposal bucket being within an interior cavity defined by said stem, said components being arranged relative to each other to move from an operative position to a removal position upon removing an entirety of said cap from said stem of said cigarette disposal unit before any part of said disposal bucket emerges from said stem, removing said disposal bucket from an interior cavity of said stem subsequent to complete removal of said cap from said stem to allow for emptying contents of said disposal bucket, said components being arranged relative to each other to return to said operative position by returning said emptied disposal bucket to said interior cavity of said stem and then returning said cap to said stem.

17. The cigarette disposal unit of claim 16, wherein the said disposal bucket is dangling from said cap with a component selected from a group consisting of chain, rod and rope.

* * * * *